US010472876B2

(12) United States Patent
Shimizu et al.

(10) Patent No.: US 10,472,876 B2
(45) Date of Patent: Nov. 12, 2019

(54) WINDOW REGULATOR

(71) Applicant: Johnan Manufacturing Inc., Nagano (JP)

(72) Inventors: Hiroki Shimizu, Nagano (JP); Manabu Shimomura, Nagano (JP); Seiichi Miyamoto, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 0 days.

(21) Appl. No.: 15/115,512

(22) PCT Filed: Feb. 5, 2015

(86) PCT No.: PCT/JP2015/053255

§ 371 (c)(1),
(2) Date: Jul. 29, 2016

(87) PCT Pub. No.: WO2015/119201

PCT Pub. Date: Aug. 13, 2015

(65) Prior Publication Data

US 2017/0159346 A1 Jun. 8, 2017

(30) Foreign Application Priority Data

Feb. 6, 2014 (JP) ..... 2014-021493

(51) Int. Cl.
*E05F 15/689* (2015.01)
*E05D 15/16* (2006.01)

(52) U.S. Cl.
CPC ..... *E05F 15/689* (2015.01); *E05D 15/165* (2013.01); *E05Y 2900/55* (2013.01)

(58) Field of Classification Search
CPC ..... E05F 15/689; E05F 15/697; B60J 1/17; B60J 5/0419
See application file for complete search history.

(56) References Cited

U.S. PATENT DOCUMENTS 4,389,818 A * 6/1983 Sakamoto ..... B60J 1/17 49/349
4,970,827 A * 11/1990 Djordjevic ..... E05F 11/488 49/349

(Continued)

FOREIGN PATENT DOCUMENTS

DE 199 30 541 * 1/2001
DE 19930541 A1 1/2001

(Continued)

OTHER PUBLICATIONS

International Search Report issued in a corresponding application No. PCT/JP2015/053255 dated Apr. 14, 2015.

(Continued)

*Primary Examiner* — Gregory J Strimbu
(74) *Attorney, Agent, or Firm* — Roberts Mlotkowski Safran Cole & Calderon P.C.

(57) ABSTRACT

A window regulator (1) provided in a door (9) of a vehicle to raise and lower a windowpane (90) in the door (9) includes a guide rail (20) arranged along the travel direction of the windowpane (90), a wire (3) extending along the longitudinal direction of the guide rail (20), and a traveling body (4) that is guided by the guide rail (20) and travels together with the windowpane (90). The traveling body (4) includes a drum (40) with a part of the wire (3) wound thereon, a motor (5) generating a drive force that rotates and drives the drum (40), and a housing (6) that holds the drum (40) and the motor (5). The motor (5) is more outwardly situated in a vehicle width direction than the guide rail (20) in the door (9).

7 Claims, 8 Drawing Sheets

(56) References Cited

U.S. PATENT DOCUMENTS

| | | | | |
|---|---|---|---|---|
| 7,213,370 | B2 * | 5/2007 | Dedrich | E05F 11/382 49/358 |
| 2002/0162280 | A1 * | 11/2002 | Shah | E05F 11/481 49/352 |
| 2004/0010975 | A1 | 1/2004 | Chonavel et al. | |
| 2006/0059781 | A1 * | 3/2006 | Berklich, Jr. | E05F 11/483 49/352 |
| 2006/0059782 | A1 * | 3/2006 | Garcia | B60R 16/0215 49/358 |
| 2008/0005971 | A1 * | 1/2008 | Dickie | E05F 15/689 49/349 |
| 2008/0155901 | A1 * | 7/2008 | Rietdijk | E05F 11/423 49/349 |
| 2017/0051550 | A1 * | 2/2017 | Ikeda | E05F 15/689 |

FOREIGN PATENT DOCUMENTS

| | | | |
|---|---|---|---|
| EP | 0384019 | A1 | 12/1989 |
| EP | 1347139 | A1 | 9/2003 |
| JP | 2006-257764 | A | 9/2006 |

OTHER PUBLICATIONS

Office Action issued in the corresponding Chinese Application No. 2015800070844 dated Feb. 21, 2017.

Notification of Transmittal of Translation of the International Preliminary Report on Patentability for application PCT/JP2015/053255 dated Aug. 18, 2016.

Office Action issued in the corresponding Chinese Application No. 2015800070844 dated Dec. 4, 2017.

Office Action issued in the corresponding Indian Application No. 201647026133 dated Apr. 30, 2019.

Chinese Patent Application No. 201580007084.4 Office Action, dated Jul. 21, 2017, and English translation thereof.

* cited by examiner

WINDOW REGULATOR

CROSS-REFERENCE TO RELATED APPLICATIONS

The present application is a U.S. National Phase of PCT/JP2015/053255 filed on Feb. 5, 2015 claiming priority to Japanese Patent application No. 2014-021493 filed on Feb. 6, 2014. The disclosure of the PCT Application is hereby incorporated by reference into the present Application.

TECHNICAL FIELD

The present invention relates to a window regulator that raises and lowers a windowpane in a vehicle door.

BACKGROUND ART

Conventionally, a window regulator is used in the vehicle door so as to raise and lower the windowpane by a drive force of a motor. One of such window regulators is a self-propelled window regulator configured that a motor thereof moves together with a window glass (see, e.g., JP-A-2006-257764).

The window regulator described in JP-A-2006-257764 is provided with a fixed portion fixed to a vehicle door so as to extend along the travel direction of the window glass, and a drive unit to move the window glass. The drive unit has a motor as a drive source and moves together with the window glass. The fixed portion extends in a door height direction and guides the movement of the drive unit.is provided with a fixed portion fixed to a vehicle door so as to extend along the travel direction of the window glass, and a drive unit to move the window glass. The drive unit has a motor as a drive source and moves together with the window glass. The fixed portion extends in a door height direction and guides the movement of the drive unit.

In more detail, the fixed portion has a rack bracket fixed to the door and a rack fixed to the rack bracket. The drive unit has a pinion gear rotationally driven by the motor and a housing for supporting the pinion gear and the motor. The pinion gear has pinion teeth which mesh with rack teeth formed on the rack. If the pinion gear is rotated in a state that the rack teeth mesh with the pinion teeth, the drive unit moves together with the window glass along a longitudinal direction of the rack bracket (a vertical direction).

The rack teeth of the rack are formed to protrude toward the rear side of the door, and the pinion gear is arranged on the rear side of the door relative to the rack. The motor is arranged further on the rear side of the door beyond the pinion gear and is aligned with the rack and the rack bracket in the front-back direction of the vehicle. The rotational axis of the motor is orthogonal to the longitudinal direction of the rack bracket.

SUMMARY OF INVENTION

Technical Problem

In the window regulator described in JP-A-2006-257764, since the motor is aligned with the rack and rack bracket in the front-back direction of the vehicle, a protruding length of the drive unit from the fixed portion toward the rear side of the door is large. Therefore, for example, a storage compartment to be used by a passenger, when provided on the inner wall of the door on the vehicle interior side, needs to be arranged to avoid contact between the inner wall and the drive unit over the entire stroke of its travel and this may greatly limit the position and size of the storage compartment.

It is an object of an embodiment of the invention to provide a window regulator that can increase the space on the car interior side of an inner wall of a door while avoiding contact between the inner wall and the motor.

Solution to Problem

According to one embodiment of the invention, provided is a window regulator which is provided in a door of a vehicle to raise and lower a windowpane in the door and comprises:

- a guide rail arranged along a travel direction of the windowpane;
- a wire tensely fitted along a longitudinal direction of the guide rail; and
- a traveling body that is guided by the guide rail and travels together with the windowpane,
- wherein the traveling body comprises a drum with a part of the wire wound thereon, a motor that generates a drive force to rotate and drive the drum, and a housing that holds the drum and the motor, and wherein the motor is more outwardly situated in a vehicle width direction than the guide rail in the door.

Advantageous Effects of Invention

According to an embodiment of the invention, a window regulator can be provided that can increase the space on the car interior side of an inner wall of a door while avoiding contact between the inner wall and the motor.

DESCRIPTION OF EMBODIMENTS

First Embodiment

The first embodiment of the invention will be described in reference to FIGS. 1 to 5.

Figure 1:
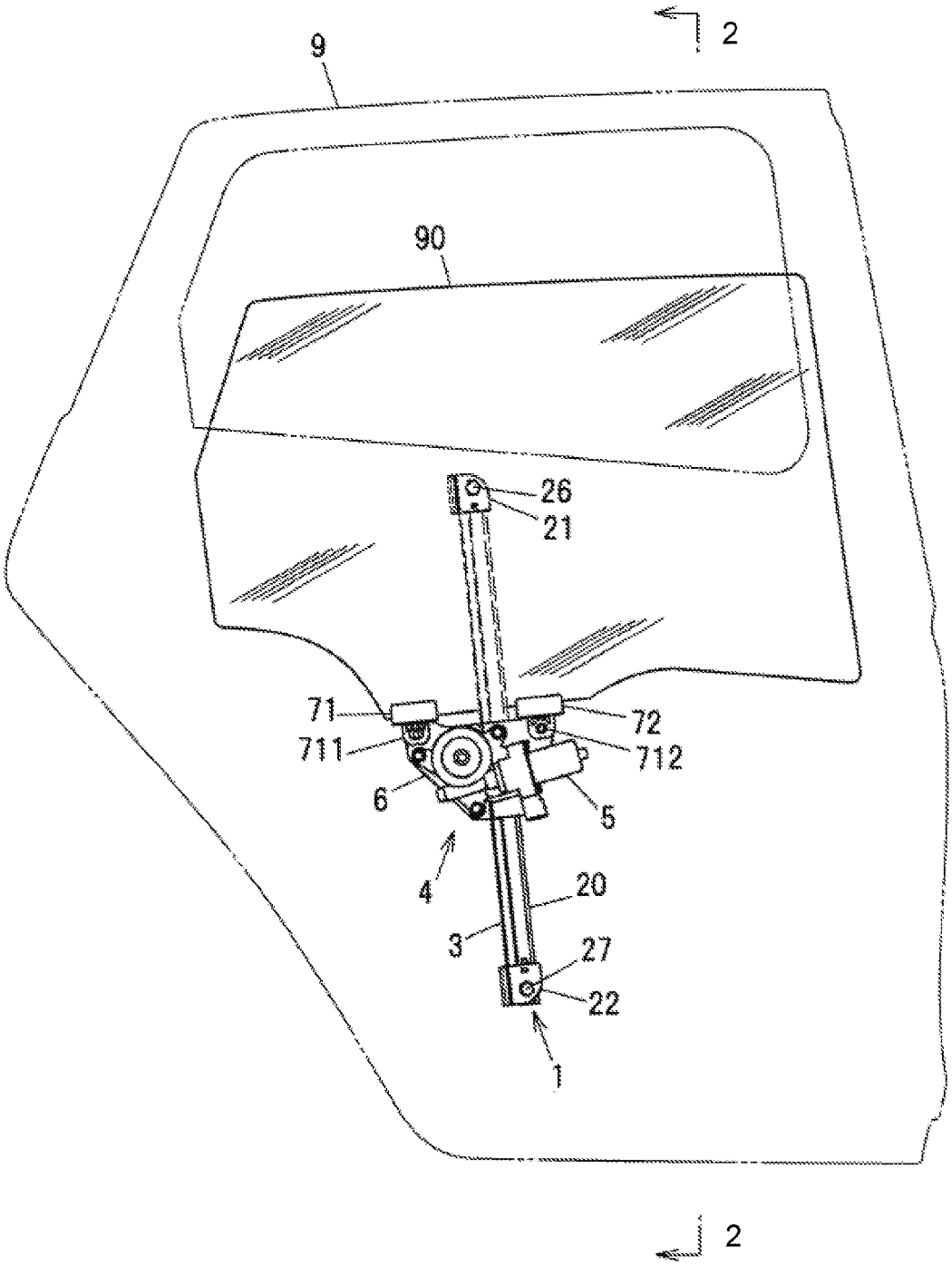
FIG. 1 is an illustration diagram showing a window regulator in a first embodiment of the present invention and a vehicle door mounting the window regulator.

FIG. 1 is an illustration diagram showing a window regulator in the first embodiment and a vehicle door mounting the window regulator. FIG. 1 shows a right rear door when viewing from the outside of the vehicle. In addition, in FIG. 1, the outline of the door and the window frame are indicated by phantom lines (dash-dot-dot lines), and a portion of the window regulator arranged on the inner side (the vehicle interior side) of the windowpane is indicated by a dashed line.

A window regulator 1 is provided in a door 9 of a vehicle to raise and lower a windowpane 90 of the door 9. The windowpane 90 moves vertically while being guided by a window guide (not shown). Although FIG. 1 shows an example in which the window regulator 1 is used in the right rear door of the vehicle, it is also possible to provide the window regulator 1 in another door of the vehicle.

The window regulator 1 is provided with a guide rail 20 arranged along the travel direction of the windowpane 90, a wire 3 tensely fitted along the longitudinal direction of the guide rail 20, and a traveling body 4 which is guided along the guide rail 20 and travels together with the windowpane 90. The traveling body 4 has a drum 40 (shown in FIG. 4 described later) with a portion of the wire 3 wound thereon, a motor 5 generating a drive force to rotate and drive the drum 40, a housing 6 holding the drum 40 and the motor 5, and joining members 71 and 72 which join the windowpane 90 to the housing 6. The detailed configuration of the traveling body 4 will be described later.

A first wire support member 21 is arranged at an upper end section of the guide rail 20, and a second wire support member 22 is arranged at a lower end section of the guide rail 20. The first wire support member 21 and the second wire support member 22 serves as a pair of wire support portions for supporting both end sections of the wire 3.

The motor 5 is arranged at a position not overlapping the joining members 71 and 72 when viewing the window regulator 1 in the vehicle width direction. In more detail, the motor 5 is arranged at a downwardly offset position with respect to the joining member 72 which is fixed to the housing 6 at an edge on the forward side of the vehicle. This reduces the thickness of the traveling body 4 in the vehicle width direction while avoiding contact of the motor 5 with the joining members 71 and 72.

Figure 2:
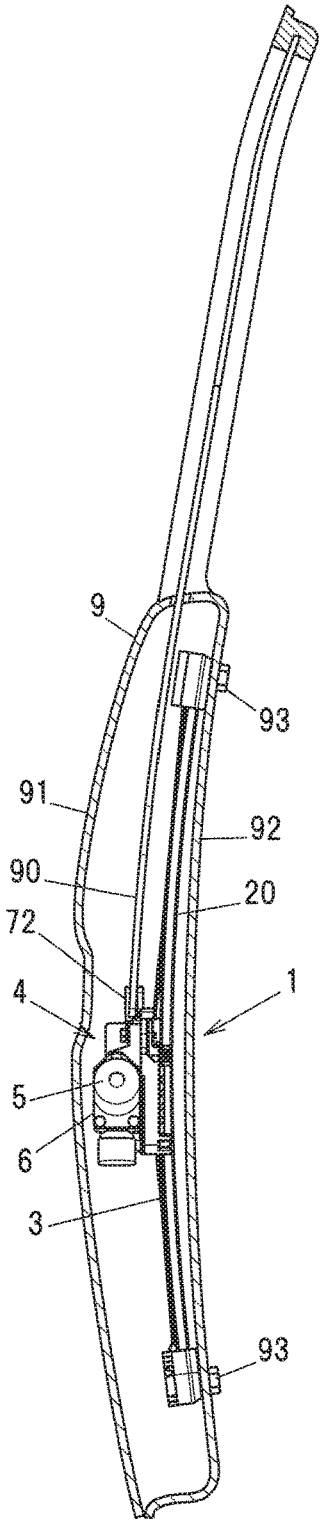
FIG. 2 is a cross sectional view taken along a line 2-2 in FIG. 1 and showing the inside of the door mounting the window regulator.

FIG. 2 is a cross sectional view taken along the line 2-2 in FIG. 1 and showing the inside of the door 9 mounting the window regulator 1.

The window regulator 1 is arranged between an outer wall 91 and an inner wall 92 of the door 9. A surface of the inner wall 92 on the vehicle interior side (on the opposite side to the outer wall 91) is covered with a lining (not shown) formed of, e.g., a resin. The outer wall 91 is curved such that the middle portion in a height direction bulges outward in the vehicle width direction. The windowpane 90 is also curved such that the middle portion in a height direction bulges outward in the vehicle width direction, in the same manner as the outer wall 91. The guide rail 20 is curved in an arc shape along the windowpane 90.

The first wire support member 21 and the second wire support member 22 of the window regulator 1 are fixed to the inner wall 92. The first wire support member 21 is attached to the inner wall 92 by a bolt 26 (shown in FIG. 1) which is inserted through the first wire support member 21. A tip portion of the bolt 26 penetrates the inner wall 92 and is threaded into a nut 93 which is arranged on the vehicle interior side of the inner wall 92. Meanwhile, the second wire support member 22 is attached to the inner wall 92 by a bolt 27 (shown in FIG. 1) which is inserted through the second wire support member 22. A tip portion of the bolt 27 penetrates the inner wall 92 and is threaded into another nut 93 which is arranged on the vehicle interior side of the inner wall 92.

The motor 5 is arranged inside the door 9 further on the outside in the vehicle width direction than the guide rail 20. A space with a width which does not disturb the movement of the traveling body 4 is formed between the guide rail 20 and the outer wall 91.

Figure 3:
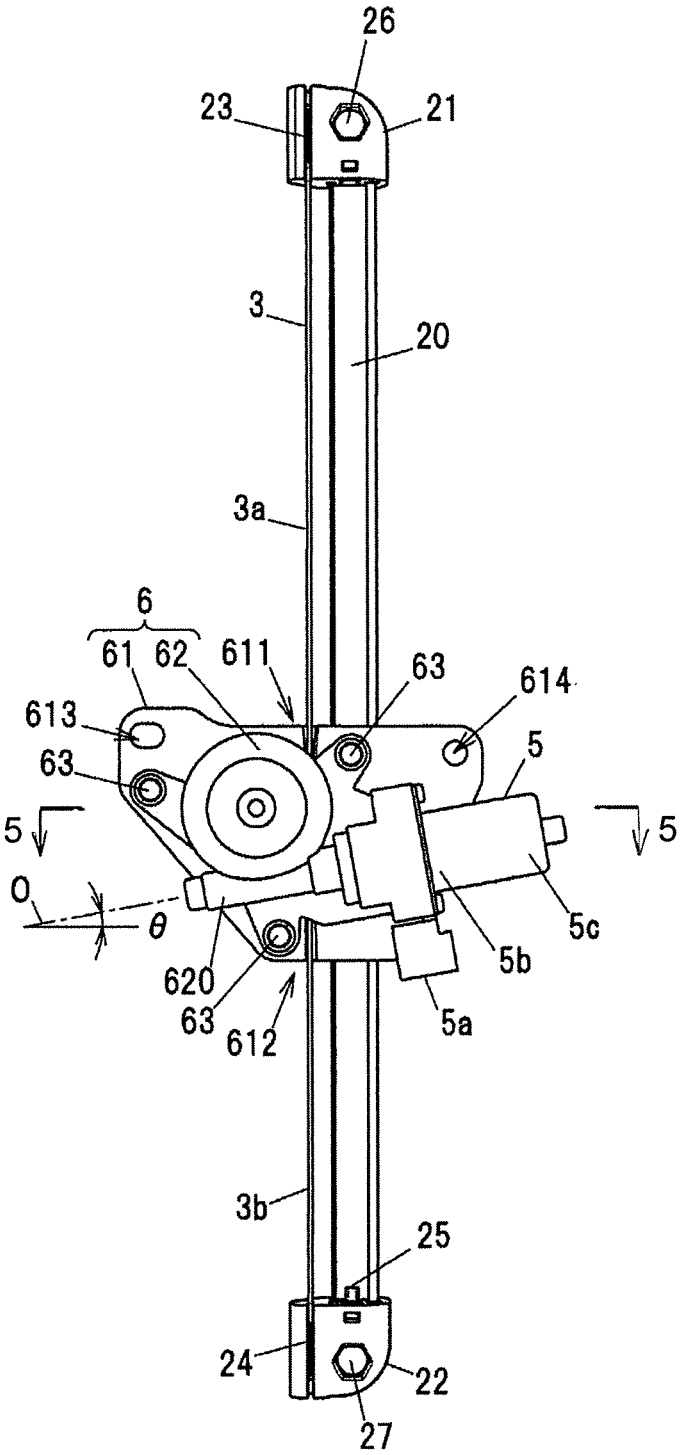
FIG. 3 is an illustration diagram showing the entire window regulator.
Figure 4:
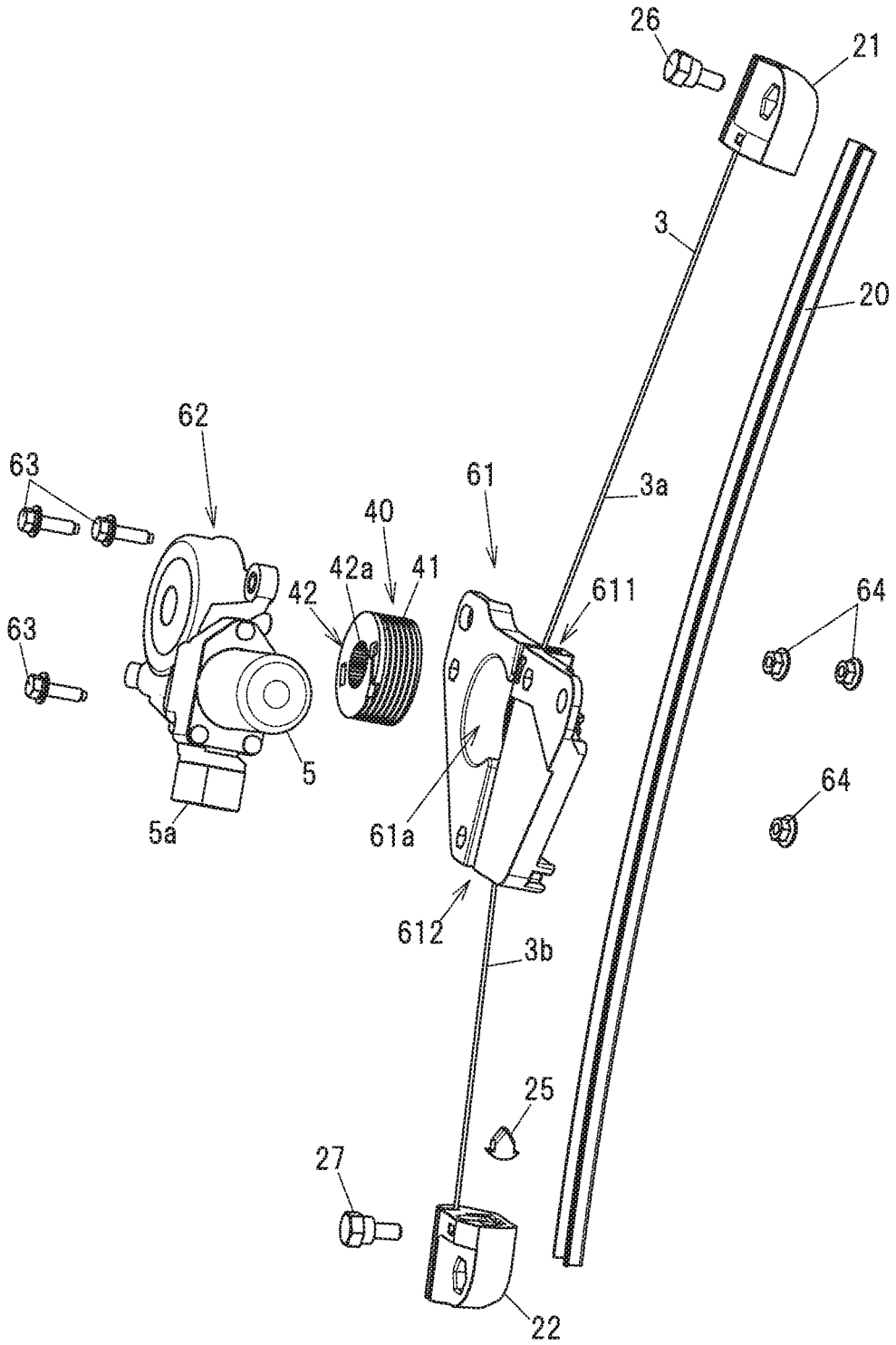
FIG. 4 is an exploded perspective view showing the window regulator.
Figure 5:
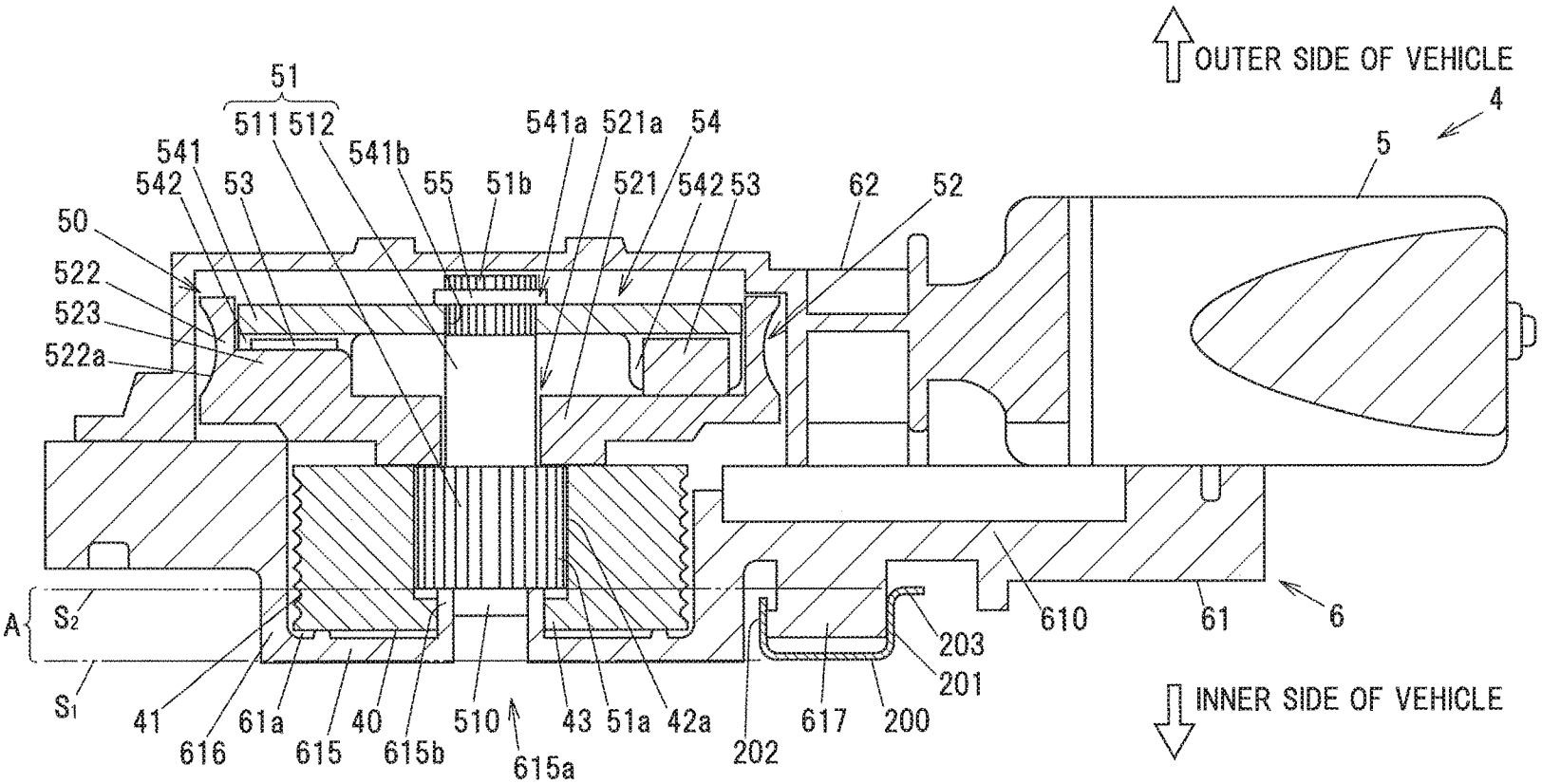
FIG. 5 is a cross sectional view taken along a line 5-5 in FIG. 3.

Next, the configuration of each component of the window regulator 1 will be described in detail in reference to FIGS. 3 to 5. FIG. 3 is an illustration diagram showing the entire window regulator 1. FIG. 4 is an exploded perspective view showing the window regulator 1. FIG. 5 is a cross sectional view taken along the line 5-5 in FIG. 3. In the following description, "up/upper/above" and "down/lower/below" mean "an upper side" and "a lower side" of the window regulator 1 when mounted on the door 9.

As shown in FIGS. 3 and 4, the housing 6 is composed of a drum housing 61 for housing the drum 40 and a gear housing 62 for housing a worm gear mechanism 50 (shown in FIG. 5 and described later). The drum housing 61 and the gear housing 62 are fastened to each other by plural bolts 63 and nuts 64. Both the drum housing 61 and the gear housing 62 are formed of resins. In more detail, the drum housing 61 is formed of, e.g., polyacetal (POM) and the gear housing 62 is formed of, e.g., polybutylene terephthalate (PBT).

As shown in FIG. 4, a housing space 61*a* for housing the drum 40 is formed on the drum housing 61. In addition, a first guide groove 611 and a second guide groove 612 for guiding the wire 3 to the housing space 61*a* are formed on the drum housing 61. The first guide groove 611 is formed above the housing space 61*a* and opens toward the first wire support member 21. The second guide groove 612 is formed below the housing space 61*a* and opens toward the second wire support member 22. The first guide groove 611 and the second guide groove 612 are formed at position offset from the center of the housing space 61*a* toward the guide rail 20.

The drum housing 61 also has through-holes 613 and 614 formed at both ends in a front-back direction of the vehicle. The joining members 71 and 72 (shown in FIG. 1) are fixed to the drum housing 61 by bolts 711 and 712 (shown in FIG. 1) which are respectively inserted into the through-holes 613 and 614.

The drum 40 is formed in a cylindrical shape and has a helical groove 41 on the outer surface thereof. In addition, inner splines 42*a* extending in an axial direction of the drum 40 are formed on an inner peripheral surface of a center hole 42 of the drum 40.

The wire 3 is tensioned by springs 23 and 24 (shown in FIG. 3) which are held by the first wire support member 21 and the second wire support member 22. Thus, the wire 3 is tightly stretched without looseness between the first wire support member 21 and the second wire support member 22. The detailed configuration of the first wire support member 21 and the second wire support member 22 will be described later.

The routing path of the wire 3, which starts from the end section on the first wire support member 21 side and terminates at the end section on the second wire support member 22 side, is as follows: the wire 3 extending out of the first wire support member 21 runs downward along the guide rail 20 and is guided into the housing space 61*a* via the first guide groove 611 of the drum housing 61. The wire 3 guided into the housing space 61*a* is wound around the drum 40 several times so as to be fitted in the groove 41 on the outer surface of the drum 40, and extends out to the outside of the drum housing 61 via the second guide groove 612. The wire 3 extending out from the second guide groove 612 runs downward along the guide rail 20 and is supported by the second wire support member 22 such that no portion of the guide rail 20 is disposed between the wire 3 and the inner wall 92 of the door 9. The guide grooves 611, 612 guide the wire 3 to tangential positions on a side of the drum 40 such that the wire 3 is closer to the guide rail 20 than the drum 40 in a front-back direction of the vehicle.

When the wire 3 between the first wire support member 21 and the drum housing 61 is defined as an upper wire 3*a* and the wire 3 between the second wire support member 22 and the drum housing 61 as a lower wire 3*b*, rotation of the drum 40 causes a change in lengths of the upper wire 3*a* and the lower wire 3*b*. In other words, when the rotation direction of the drum 40 during ascent of the traveling body 4 is defined as a forward direction and the rotation direction of the drum 40 during descent of the traveling body 4 as a reverse direction, the rotation of the drum 40 in the forward direction causes the length of the upper wire 3*a* to be shortened and the length of the lower wire 3*b* to be lengthened. Inversely, the rotation of the drum 40 in the reverse direction causes the length of the upper wire 3*a* to be lengthened and the length of the lower wire 3*b* to be shortened. The traveling body 4 moves vertically along the guide rail 20 according to the change in the lengths of the upper wire 3*a* and the lower wire 3*b*.

The motor 5 is a DC motor which receives an electric current through a connector portion 5*a* and generates a rotational drive force. A worm (not shown) housed in a cylindrical portion 620 of the gear housing 62 is coupled to a rotor of the motor 5 so as to rotate integrally. As shown in FIG. 3, a rotation axis O of the rotor of the motor 5 and the worm is inclined at an angle θ with respect to a straight line orthogonal to the longitudinal direction of the guide rail 20. With the inclination of the rotation axis O, the motor 5 is arranged such that a front end portion 5*c* on the opposite side to the gear housing 62 is located higher than a base end portion 5*b* fixed to the gear housing 62.

The rotation of the motor 5 is decelerated by the worm gear mechanism 50 (described later) housed in the gear housing 62 and is transmitted to the drum 40 via the output shaft 51 (shown in FIG. 5) of the worm gear mechanism 50. As shown in FIG. 5, an end portion of an output shaft 51 protrudes from the gear housing 62. Outer splines 51*a* to be engaged with the inner splines 42*a* (shown in FIG. 4) formed on the inner peripheral surface of the center hole 42 of the drum 40 are formed on the outer peripheral surface of the end portion of the output shaft 51.

The output shaft 51 is coupled to the drum 40 by spline engagement between the outer splines 51*a* and the inner splines 42*a* of the drum 40 so as not to be relatively rotatable. In addition, a supported portion 510 is formed at the center of the output shaft 51 protruding from the gear housing 62 and is supported by the drum housing 61. The supported portion 510 has a smaller diameter than the portion having the outer splines 51*a* and protrudes toward the drum housing 61.

As shown in FIG. 5, the worm gear mechanism 50 has the output shaft 51, a worm wheel 52 which meshes with the worm (not shown) coupled to the rotor of the motor 5, plural dumpers 53 formed of an elastic body such as rubber, and a hub 54 which receives a rotational force from the worm wheel 52 via the plural dumpers 53 and rotates integrally with the output shaft 51. In FIG. 5, the outer side of the vehicle (the outer wall 91 side of the door 9) is shown on the upper side and the inner side of the vehicle (the inner wall 92 side of the door 9) is shown on the lower side.

The output shaft 51 integrally has a large diameter portion 511 protruding from the gear housing 62 and a small diameter portion 512 having a smaller diameter than the large diameter portion 511. The outer splines 51*a* to be spline-engaged with the inner splines 42*a* of the drum 40 are formed on the outer peripheral surface of the large diameter portion 511. On the small diameter portion 512, outer splines 51*b* to be spline-engaged with the hub 54 are formed at an end on the opposite side to the large diameter portion 511.

The worm wheel 52 integrally has a circular plate-shaped bottom portion 521 having an insertion hole 521*a* formed in the center for insertion of the output shaft 51, an outer circumferential wall portion 522 formed along the outer rim of the bottom portion 521 so as to protrude in the axial direction, and plural inner wall portions 523 protruding inward from an inner surface of the outer circumferential wall portion 522. Only one of the plural inner wall portions 523 is shown in FIG. 5.

Worm teeth 522*a* are formed on the outer peripheral surface of the outer circumferential wall portion 522. An inner diameter of the insertion hole 521*a* of the bottom portion 521 is larger than an outer diameter of the small diameter portion 512 of the output shaft 51, so a small gap is formed between the inner peripheral surface of the insertion hole 521*a* and the outer peripheral surface of the small diameter portion 512 of the output shaft 51.

The hub 54 integrally has a disk-shaped main body 541 having an insertion hole 541*a* formed in the center for insertion of the small diameter portion 512 of the output shaft 51, and plural protrusions 542 protruding from the main body 541 toward the bottom portion 521 of the worm wheel 52. Inner splines 541*b* to be spline-engaged with the outer splines 51*b* of the small diameter portion 512 of the output shaft 51 are formed on the inner peripheral surface of the insertion hole 541*a*. The hub 54 is restricted from relatively moving with respect to the output shaft 51 by a snap ring 55 which is fitted to the small diameter portion 512 of the output shaft 51.

The dumpers 53 are sandwiched between the inner wall portions 523 of the worm wheel 52 and the protrusions 542 of the hub 54. The dumpers 53 have a function of absorbing torque pulsation of the motor 5 to smoothly rotate the output shaft 51. The worm wheel 52 and the hub 54 are relatively rotatable in an elastically deformable and compressible range of the dumpers 53. The worm gear mechanism 50 having such a configuration decelerates the rotation of the rotor of the motor 5 and transmits the rotation to the output shaft 51 while reducing the torque pulsation.

The drum housing 61 has a through-hole 615*a* formed in the center of a bottom portion 615 which defines the housing space 61*a*. Also, a cylindrical protruding portion 615*b* is formed around the through-hole 615*a* of the bottom portion 615. The supported portion 510 of the output shaft 51 is inserted into the protruding portion 615*b*. The supported portion 510 is thereby supported by the drum housing 61, resulting in that the output shaft 51 is rotatably supported.

An inner flange portion 43 is formed to protrude inward from the inner peripheral surface of the center hole 42 of the drum 40 at an edge on a side facing the bottom portion 615 of the drum housing 61. The front end surface of the inner flange portion 43 faces the outer peripheral surface of the protruding portion 615*b* with a small gap therebetween. Thus, the drum 40 is rotatably supported inside the housing space 61*a*. The outer peripheral surface of the drum 40 faces a circumferential wall portion 616 which, together with the bottom portion 615, defines the housing space 61*a*.

In addition, a protruding strip 617 extending in the vertical direction is formed on the drum housing 61. The protruding strip 617 protrudes from a main body 610 of the drum housing 61 toward the inner wall 92 of the door 9

(toward the vehicle interior). The protruding strip 617 slides and moves on the guide rail 20 and the drum housing 61 is thereby guided along the guide rail 20.

The guide rail 20 is formed by bending, e.g., a metal plate such as zinc steel plate. The guide rail 20 integrally has a flat plate portion 200 extending in the longitudinal direction thereof (the vertical direction), a first side wall portion 201 and a second side wall portion 202 which are provided upright on the flat plate portion 200 to protrude from both edges in a width direction toward the main body 610 of the drum housing 61, and a flange portion 203 protruding from a top end of the first side wall portion 201 toward the opposite side to the flat plate portion 200. The width direction here is a lateral direction orthogonal to the longitudinal direction of the guide rail 20 and corresponds to the front-back direction of the vehicle.

The protruding strip 617 of the drum housing 61 is arranged between the first side wall portion 201 and the second side wall portion 202. That is, since the protruding strip 617 is interposed between the first side wall portion 201 and the second side wall portion 202, the drum housing 61 is restricted from tilting relative to the guide rail 20.

The drum 40 is arranged alongside of the guide rail 20 in the front-back direction of the vehicle such that no portion of the guide rail 20 is disposed between the drum 40 and the inner wall 92 of the door 9. In more detail, when a range in the vehicle width direction in which the guide rail 20 is present is defined as a region A, the drum 40 is arranged in at least a portion of the region A. In FIG. 5, a dash-dot-dot line $S_1$ is a line which passes through the end section of the guide rail 20 on the vehicle interior side and is parallel to the front-back direction of the vehicle, and a dash-dot-dot line $S_2$ is a line which passes through the end section of the guide rail 20 on the vehicle outer side and is parallel to the front-back direction of the vehicle. The area sandwiched between the dash-dot-dot line $S_1$ and the dash-dot-dot line $S_2$ is the region A.

In the first embodiment, the dash-dot-dot line $S_2$ intersects with the drum 40 but the dash-dot-dot line $S_1$ does not intersect with the drum 40. Thus, a portion of the drum 40 on a side facing the bottom portion 615 of the drum housing 61 is located in the region A, resulting in that the drum 40 and the guide rail 20 are arranged side-by-side in the front-back direction of the vehicle. Alternatively, both the dash-dot-dot line $S_1$ and the dash-dot-dot line $S_2$ may intersect with the drum 40 so that the drum 40 is present in the entire width of the region A.

(Functions and Effects of the First Embodiment)

The following functions and effects are obtained in the first embodiment.

(1) The motor 5 is arranged further on the outside in the vehicle width direction than the guide rail 20. In other words, the motor 5 is not arranged between the guide rail 20 and the inner wall 92 of the door 9. Therefore, when a storage compartment is provided on the inner side of the door 9 (on the vehicle interior side), limitation of the position or size thereof is reduced. In addition, contact between the motor 5 with the inner wall 92 of the door 9 can be avoided easier than when the motor 5 is arranged parallel to the guide rail 20 in the front-back direction of the vehicle. That is, in the first embodiment, focusing on that the outer wall 91 of the door 9 of the vehicle is curved such that the middle portion in a height direction bulges outward, the motor 5 is arranged further on the outside in the vehicle width direction than the guide rail 20 to effectively use a space formed between the outer wall 91 and the guide rail 20. As a result, it is possible to increase a space on the vehicle interior side of the inner wall 92 while avoiding contact between the inner wall 92 of the door 9 and the motor 5.

(2) Since the drum 40 is arranged alongside of the guide rail 20 in the front-back direction of the vehicle, it is possible to reduce the thickness of the traveling body 4 in the vehicle width direction. That is, although the traveling body 4 is thickest at a portion in which the drum 40 and the worm gear mechanism 50 are arranged since the drum 40 and the worm gear mechanism 50 are arranged side-by-side in the vehicle width direction, an increase in thickness of the traveling body 4 to more than the thickness of the portion having the drum 40 and the worm gear mechanism 50 can be avoided by arranging the drum 40 and the guide rail 20 in the front-back direction of the vehicle.

(3) The motor 5 is arranged at a position not overlapping the joining members 71 and 72 when viewing in the vehicle width direction. As a result, the motor 5 and the joining members 71 and 72 do not need to be arranged offset from each other in the vehicle width direction to prevent contact therebetween, which contributes to reduce the thickness of the traveling body 4.

Second Embodiment

Next, the second embodiment of the invention will be described in reference to FIGS. 6 and 7. A window regulator 1A in the second embodiment is different from the window regulator 1 in the first embodiment in that the shapes of a guide rail 20A and a housing 6A are different from the shapes of the guide rail 20 and the housing 6, and the remaining configuration is the same as the window regulator 1 in the first embodiment. Constituent elements having substantially the same functions as those described in the first embodiment are denoted by the same reference numerals in FIGS. 6 and 7 and the overlapping explanation will be omitted.

Figure 6:
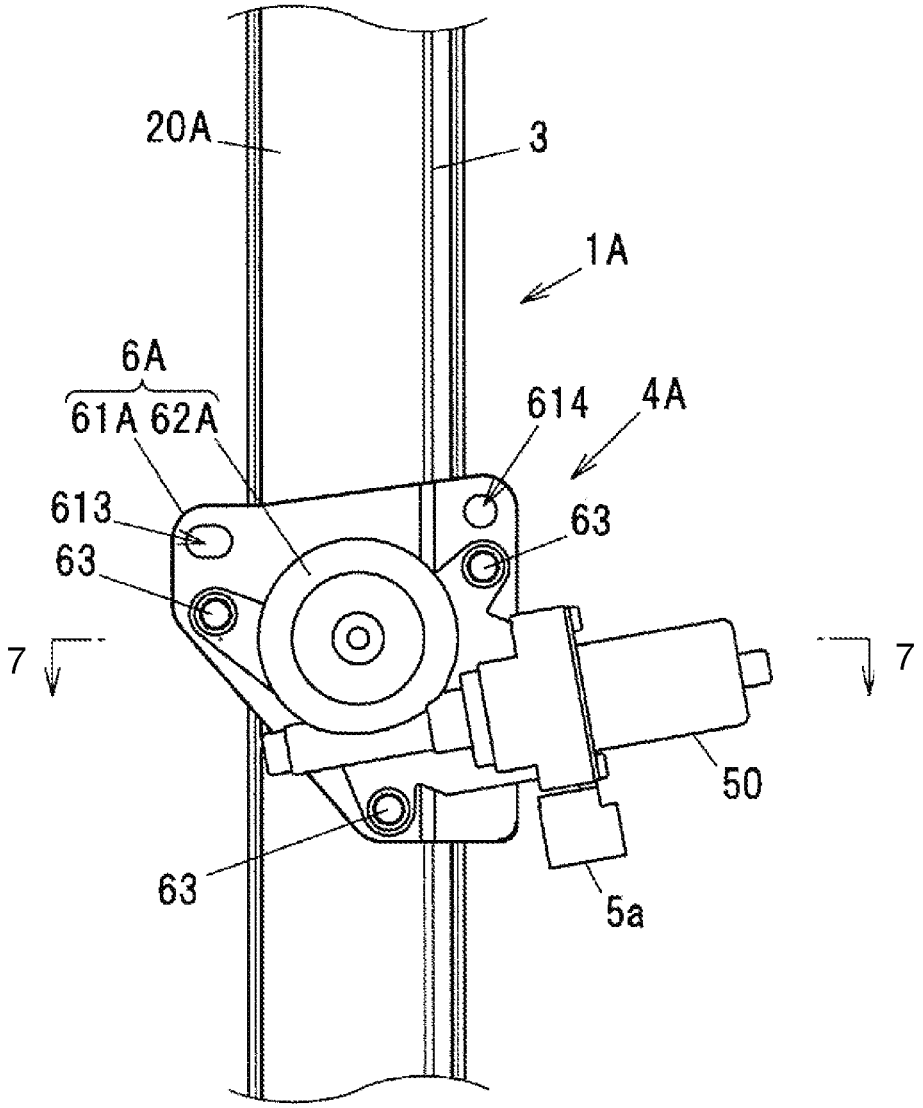
FIG. 6 is a front view showing the main portion of a window regulator in a second embodiment of the invention.
Figure 7:
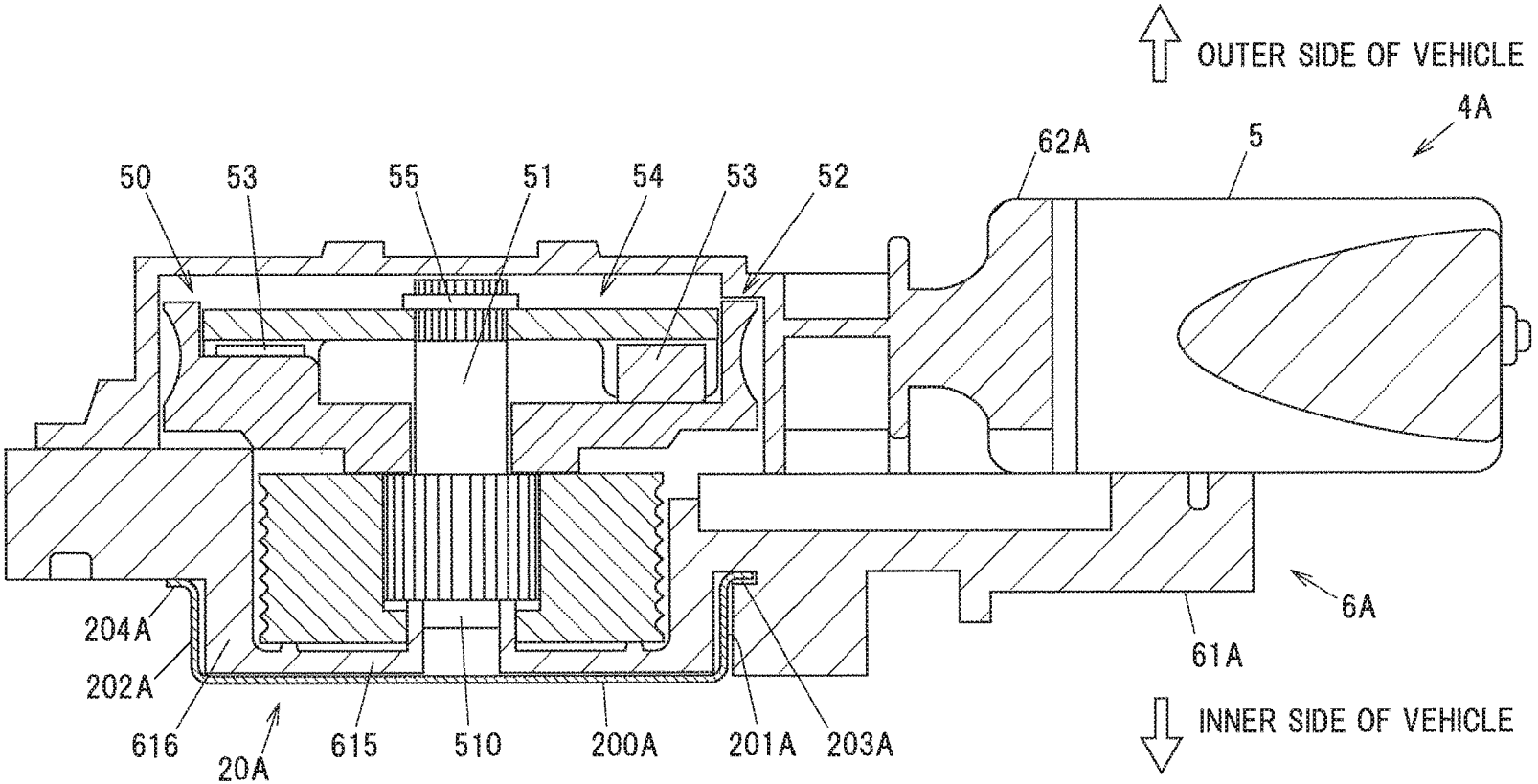
FIG. 7 is a cross sectional view taken along a line C-C in FIG. 6.

FIG. 6 is a front view showing the main portion of the window regulator 1A in the second embodiment. FIG. 7 is a cross sectional view taken along the line 7-7 in FIG. 6. The window regulator 1A is configured that a windowpane (not shown) fixed to the housing 6A of the traveling body 4A is raised or lowered by moving the traveling body 4A along the guide rail 20A.

The housing 6A is composed of a drum housing 61A and a gear housing 62A. The guide rail 20A integrally has a flat plate portion 200A extending in the longitudinal direction thereof, a first side wall portion 201A and a second side wall portion 202A as a pair of side wall portions which are provided upright on the flat plate portion 200A to protrude from both edges in a width direction (a direction orthogonal to the longitudinal direction) toward the vehicle outer side, a first flange portion 203A protruding from a top end of the first side wall portion 201A toward the opposite side to the flat plate portion 200A, and a second flange portion 204A protruding from a top end of the second side wall portion 202A toward the opposite side to the flat plate portion 200A.

In the second embodiment, the drum housing 61A is arranged so that the bottom portion 615 and a portion of the circumferential wall portion 616, which define the housing space 61*a* for housing the drum 40, are located between the first side wall portion 201A and the second side wall portion 202A of the guide rail 20A. A portion of the drum 40 is also arranged between the first side wall portion 201A and the second side wall portion 202A. Although a portion of the drum 40 on the bottom portion 615 side is arranged between the first side wall portion 201A and the second side wall portion 202A in the second embodiment, the entire drum 40 may be arranged between the first side wall portion 201A and the second side wall portion 202A. In other words, only at least a portion of the drum 40 needs to be arranged between the first side wall portion 201A and the second side wall portion 202A. Meanwhile, the first flange portion 203A and the second flange portion 204A contribute to improve rigidity of the guide rail 20A but do not necessarily need to contribute.

The bottom portion 615 and the circumferential wall portion 616 slide and move on the guide rail 20A and the drum housing 61A is thereby guided along the guide rail 20A. In addition, since the bottom portion 615 and the circumferential wall portion 616 are interposed between the first side wall portion 201 and the second side wall portion 202 of the guide rail 20, the drum housing 61A is restricted from tilting relative to the guide rail 20A.

(Functions and Effects of the Second Embodiment)

In the second embodiment, in addition to the functions and effects (1) to (3) described in the first embodiment, it is possible to reduce the thickness of the traveling body 4A in the vehicle width direction as compared to when, e.g., the drum 40 is located outside the space between the first side wall portion 201A and the second side wall portion 202A and the drum 40 is arranged alongside of the guide rail 20A in the vehicle width direction, since the drum 40 is arranged between the first side wall portion 201A and the second side wall portion 202A of the guide rail 20A. As a result, when a storage compartment is provided on the inner side of the door 9, limitation of the position or size thereof is reduced.

Third Embodiment

Next, the third embodiment of the invention will be described in reference to FIG. 8. A window regulator in the third embodiment is different from the window regulator 1A in the second embodiment in that the shape of a guide rail 20B is different from the shape of the guide rail 20A, and the remaining configuration is the same as the window regulator 1A in the second embodiment. The following description focuses on the shape of the guide rail 20B and a positional relation between the guide rail 20B and the drum 40.

Figure 8:
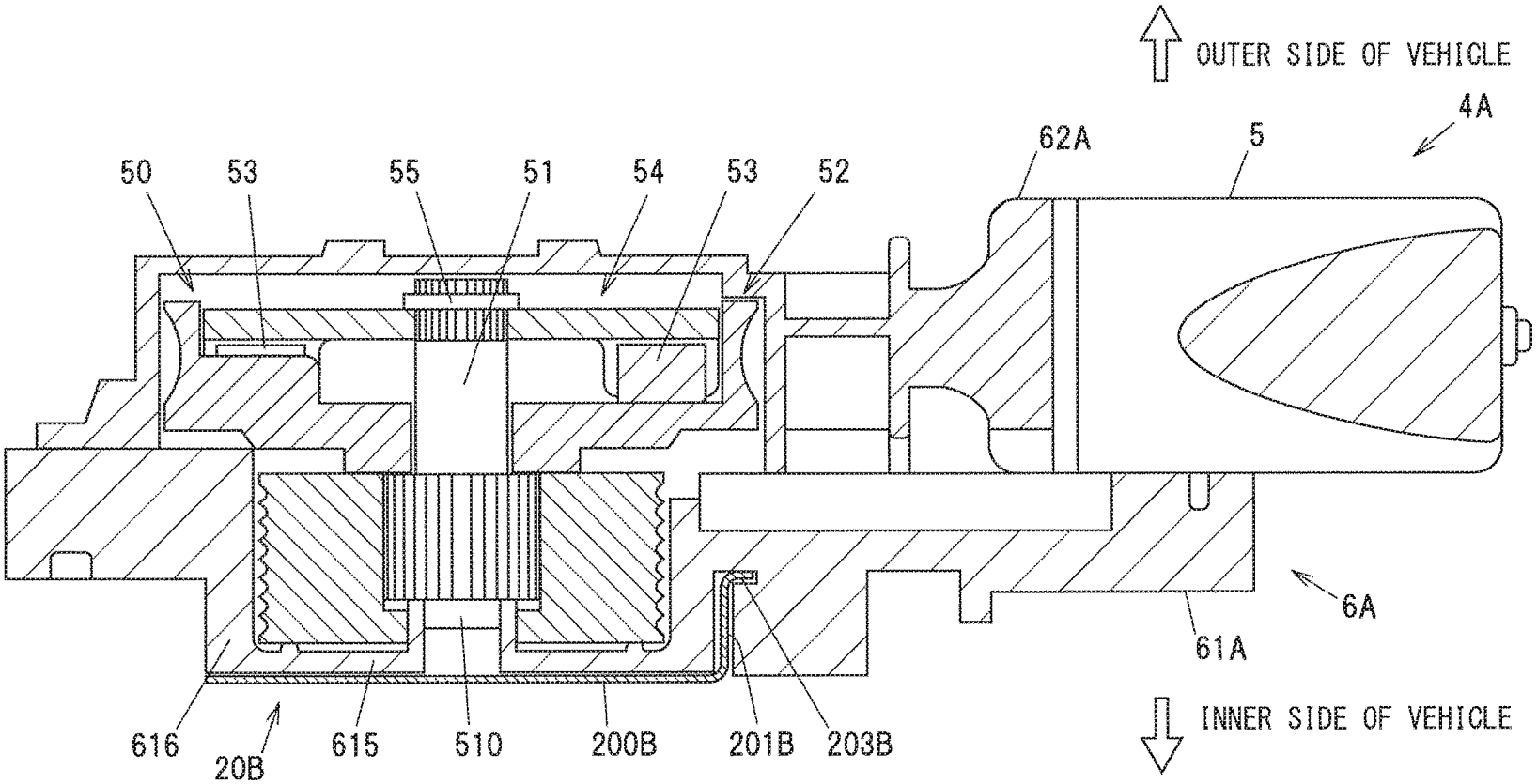
FIG. 8 is a cross sectional view showing the main portion of a window regulator in a third embodiment of the invention.

FIG. 8 is a cross sectional view showing the main portion of the window regulator in the third embodiment. The guide rail 20B integrally has a flat plate portion 200B extending in the longitudinal direction thereof, a side wall portion 201B provided upright on the flat plate portion 200B to protrude from an edge in a width direction (a direction orthogonal to the longitudinal direction) toward the vehicle outer side, and a flange portion 203B protruding from a top end of the side wall portion 201B toward the opposite side to the flat plate portion 200B. In the third embodiment, the side wall portion 201B protrudes toward the worm gear mechanism 50 from the flat plate portion 200B at an edge in the width direction on the motor 5 side. The guide rail 20B in the third embodiment does not have portions corresponding to the second side wall portion 202A and the second flange portion 204A of the guide rail 20A in the second embodiment. However, since the traveling body 4A is pressed toward the vehicle inner side by a tensile force of the wire 3, the bottom portion 615 slides and moves on the flat plate portion 200B of the guide rail 20B and the housing 6A thereby travels in the vertical direction.

In addition, in the third embodiment, the drum 40 is arranged alongside of the side wall portion 201B of the guide rail 20B in the front-back direction of the vehicle. In other words, when viewing the guide rail 20B and the drum 40 in the width direction of the flat plate portion 200B, the side wall portion 201B of the guide rail 20B overlaps the drum 40. Although a portion of the drum 40 on the bottom portion 615 side is arranged alongside of the side wall portion 201B of the guide rail 20B in the front-back direction of the vehicle in the third embodiment, the entire drum 40 may be arranged alongside of the side wall portion 201B of the guide rail 20B in the front-back direction of the vehicle. Meanwhile, the flange portion 203B contributes to improve rigidity of the guide rail 20B but does not necessarily need to contribute.

(Functions and Effects of the Third Embodiment)

In the third embodiment, in addition to the functions and effects (1) to (3) described in the first embodiment, it is possible to reduce the thickness of the traveling body 4A in the vehicle width direction as compared to when, e.g., the drum 40 is arranged on the worm gear mechanism 50 side relative to the side wall portion 201B, since the drum 40 is arranged alongside of the side wall portion 201B of the guide rail 20B in the front-back direction of the vehicle.

Although the invention has been described based on the first to third embodiments, the invention according to claims is not to be limited to the above-mentioned embodiments. Further, please note that all combinations of the features described in the embodiments are not necessary to solve the problem of the invention. In addition, the invention can be appropriately modified and implemented without departing from the gist thereof.

The invention is applicable to a window regulator provided inside a vehicle door to raise and lower a windowpane by a drive force of a motor.

1, 1A WINDOW REGULATOR
3 WIRE
4, 4A TRAVELING BODY
5 MOTOR
6, 6A HOUSING
9 DOOR
20, 20A, 20B GUIDE RAIL
21 FIRST WIRE SUPPORT MEMBER
22 SECOND WIRE SUPPORT MEMBER
40 DRUM
71, 72 JOINING MEMBER
90 WINDOWPANE
91 OUTER WALL
92 INNER WALL

What is claimed is:

1. A window regulator provided in a door of a vehicle, the vehicle having a front and a back, the window regulator being configured to raise and lower a windowpane in the door and positioned between an outer wall and an inner wall of the door, the window regulator comprising:

a guide rail extending along a travel direction of the windowpane and having outer side walls protruding toward the outer wall of the door;

a wire extending along the travel direction of the windowpane; and a traveling body that is guided by the guide rail and travels together with the windowpane, wherein the traveling body comprises a drum with a part of the wire wound thereon, a motor that generates a drive force to rotate the drum, and a housing that holds the drum and the motor, wherein the housing is adapted to move along the guide rail and is guided by the guide rail, wherein, in a vehicle width direction that is perpendicular to a front-back direction of the vehicle, the housing supports the drum and the motor with respect to the rail such that a portion of the drum is positioned closer to the outer wall of the door than the side walls of the rail, and the motor is no closer to the side walls of the rail than a surface of the drum facing the outer wall of the door in the vehicle width direction, wherein, when viewed along the guide rail in the travel direction of the windowpane, the drum is arranged at a position not overlapping with the guide rail in the vehicle width direction, and a portion of the drum and a portion of the guide rail are present in a horizontal plane that is parallel to the vehicle front-back direction, and wherein the drum is provided on one side of the guide rail in the front-back direction of the vehicle such that no portion of the guide rail is disposed between the drum and the inner wall of the door.

2. The window regulator according to claim 1, wherein the guide rail comprises a flat plate portion extending in the travel direction of the windowpane with the side walls extending from two edges of the plate portion generally perpendicular to the plate portion in a direction toward the outer wall of the door, and wherein the drum is arranged adjacent one of the side walls in the front-back direction of the vehicle.

3. The window regulator according to claim 2, wherein the housing is a one-piece housing.

4. The window regulator according to claim 2, wherein, when viewed in the vehicle width direction, the motor is arranged at a position not overlapping a joining member which joins the windowpane to the housing.

5. The window regulator according to claim 1, wherein, when viewed in the vehicle width direction, the motor is arranged at a position not overlapping a joining member which joins the windowpane to the housing.

6. The window regulator according to claim 1, wherein the wire does not overlap the guide rail in the front-back direction of the vehicle and no portion of the guide rail is disposed between the wire and the inner wall of the door in the vehicle width direction.

7. The window regulator according to claim 6, wherein the housing includes guide grooves that guide the wire on a side of the drum facing the guide rail such that the wire is closer to the rail than the side of the drum facing the guide rail in the front-back direction of the vehicle.

* * * * *